US005841044A

United States Patent [19]

Weise et al.

[11] Patent Number: 5,841,044

[45] **Date of Patent: *Nov. 24, 1998**

[54] SILVER-IRON MATERIAL FOR ELECTRICAL SWITCHING CONTACTS (I)

[75] Inventors: Wolfgang Weise, Frankfurt; Willi Malikowski, Aschaffenburg; Roger Wolmer, Gelnhausen; Peter Braumann, Alzenau; Andreas Koffler, Niederau, all of Germany

[73] Assignee: Degussa Aktiengesellschaft, Frankfurt am Main, Germany

[ * ] Notice: The term of this patent shall not extend beyond the expiration date of Pat. No. 5,728,194.

[21] Appl. No.: 751,935

[22] Filed: Nov. 19, 1996

[30] Foreign Application Priority Data

Nov. 20, 1995 [DE] Germany ..... 195 43 222.3

[51] Int. Cl.[6] ..... C22C 5/06

[52] U.S. Cl. ..... 75/232; 75/235; 75/247; 75/252; 252/513; 252/514; 419/21; 419/28; 419/42

[58] Field of Search ..... 75/232, 235, 247, 75/252; 252/513, 514; 420/801; 419/21, 26, 28, 42

[56] References Cited

U.S. PATENT DOCUMENTS

| | | | |
|---|---|---|---|
| 3,951,872 | 4/1976 | Neely | 252/513 |
| 4,204,863 | 5/1980 | Schreiner | 75/234 |
| 4,256,489 | 3/1981 | Van Wyk . | |
| 4,859,238 | 8/1989 | Weise et al. | 75/233 |
| 4,954,170 | 9/1990 | Fey et al. | 75/229 |
| 5,246,480 | 9/1993 | Haufe et al. | 75/236 |

FOREIGN PATENT DOCUMENTS

| | | |
|---|---|---|
| 0 586 411 | 7/1995 | European Pat. Off. . |
| 0 586 411 B1 | 7/1995 | European Pat. Off. . |
| 1139281 | 11/1962 | Germany . |
| AS 1 139 281 | 11/1962 | Germany . |
| 1 539 879 | 10/1970 | Germany . |
| OS 1 539 879 | 10/1970 | Germany . |
| 7418086 | 5/1974 | Germany . |
| GM 74 18 086 | 10/1974 | Germany . |
| 27 47 089 A1 | 12/1978 | Germany . |
| 2747089 | 12/1978 | Germany . |
| 29 24 238 | 12/1979 | Germany . |
| 38 16 895 A1 | 12/1988 | Germany . |
| 3816895 | 12/1988 | Germany . |
| 39 11 904 A1 | 12/1989 | Germany . |
| 3911904 | 12/1989 | Germany . |
| 43 43 550 A1 | 6/1995 | Germany . |
| 4343550 | 6/1995 | Germany . |

OTHER PUBLICATIONS

Patent Abstracts of Japan vol. 18, No. 377 (C–1225), 15 Jul. 1994 & JP06100965 12 Apr. 1994.

Patent Abstracts of Japan vol. 18, No. 377 (C–1225), 15 Jul. 1994 & JP06100963 12 Apr. 1994.

*Primary Examiner*—Ngoclan Mai
*Attorney, Agent, or Firm*—Beveridge, DeGrandi, Weilacher & Young, LLP

[57] ABSTRACT

Silver-iron materials for electrical switching contacts with properties which come very close to those of silver-nickel materials formed of 0.5 to 4.5% by weight iron and 0.05 to 2% by weight of one or more of the oxides magnesium oxide, calcium oxide, yttrium oxide, lanthanum oxide, titanium oxide, zirconium oxide, hafnium oxide, cerium oxide, niobium oxide, tantalum oxide, chromium oxide, manganese oxide, iron oxide, zinc oxide, aluminum oxide, indium oxide, silicon oxide, and tin oxide, the balance being silver.

20 Claims, No Drawings

SILVER-IRON MATERIAL FOR ELECTRICAL SWITCHING CONTACTS (I)

INTRODUCTION AND BACKGROUND

The invention relates to silver-iron materials with further oxidic additives which are useful for the fabrication of electrical switching contacts.

Electrical switching contacts include stationary and moving conducting surfaces that make and/or break electric circuits. The choice of materials depends on the application. Common contact materials include palladium, silver, gold, mercury, and various alloys. Plated and overlaid surfaces of other metals such as nickel or rhodium are used to impart special characteristics such as long wear and arc resistance or to limit corrosion.

Materials for electrical switching contacts can be prepared by powder metallurgy. Powder metallurgy is the process of manufacturing articles from metallic powders. Powder metallurgy involves three main processes. First, the metal or alloy powder must be prepared. Second, the powder must be compacted in order to have sufficient strength for handling. Third, the resulting compacted material must be heated at a high temperature in a controlled atmosphere for such a time that the density of the compact increases to the desired value.

The purpose of the powder compaction process is to bring the individual powder particles into very intimate contact so that metal-to-metal bonding takes place. This compaction confers a small amount of mechanical strength and facilitates the mass transfer that must occur later during sintering to produce densification. Sintering involves compressing metal particles into a solid under heat, but at a temperature below their melting point.

After compaction, the material is heated at a high temperature in a controlled atmosphere. During sintering, the voids within the compact are progressively eliminated by atom movements and eventually a dense compact is produced practically free from porosity.

Sintering times vary and the sintering temperature is generally not less than two thirds of the melting point of the metal in degrees Kelvin. Sometimes the temperature is much more than this.

Contact materials for use in electrical energy technology must have a high burn-up resistance, low welding force, and low contact resistance. For open-to-air switching devices with low-voltage technology, the composite material silver-nickel has proved itself useful for switching currents of less than 100 A. It has a high burn-up resistance with very good excess-temperature behavior.

However, a disadvantage of this material is that nickel,, especially in the form of dust, can have damaging effects on the human organism. For this reason, iron has been occasionally suggested as an alternative to nickel.

DE-OS 38 16 895 teaches the use of a silver-iron material for the fabrication of electrical contacts which material contains, in addition to silver, 3 to 30% by weight iron and a total of 0.05 to 5% by weight of one or several of the additives manganese, copper, zinc, antimony, bismuth oxide, molybdenum oxide, tungsten oxide, and chromium nitride. These materials have a distinctly better excess-temperature behavior with a good useful life in comparison to simple silver-iron material but are still below the values of corresponding silver-nickel materials.

The same also applies to other known contact materials based on silver-iron. For example, contact materials are disclosed in DE-OS 39 11 904 which can contain, in addition to silver, 5 to 50% by weight iron and up to 5% by weight of one or several of the oxides titanium oxide, zirconium oxide, niobium oxide, tantalum oxide, molybdenum oxide, tungsten oxide, manganese oxide, copper oxide, and zinc oxide. DE-OS 43 43 550 teaches a contact material containing, in addition to silver, iron oxide, zirconium oxide, and tungsten oxide. EP patent 0,586,411 describes a contact material of silver with 1 to 50% by weight iron and 0.01 to 5% by weight rhenium.

An object of the present invention is to find suitable silver-iron compositions that can be used for the fabrication of electrical switching contacts which compositions come as close as possible to the known silver-nickel materials in their welding tendency, contact resistance, and useful life but which at the same time avoid some of the prior art problems.

Another object of the present invention is to find a material able to be economically manufactured as a wire and be able to be welded onto contact carrier substances by resistance welding.

SUMMARY OF THE INVENTION

In achieving the above and other objects, a feature of the invention resides in a material for electrical switching contacts comprising 0.5 to 4.5% by weight iron and 0.05 to 2 % by weight of one or more of an oxide selected from the group consisting of magnesium oxide, calcium oxide, yttrium oxide, lanthanum oxide, titanium oxide, zirconium oxide, hafnium oxide, cerium oxide, niobium oxide, tantalum oxide, chromium oxide, manganese oxide, iron oxide, zinc oxide, aluminum oxide, indium oxide, silicon oxide, and tin oxide, the balance being silver.

A further feature of the invention resides in a method of making an electrical switching contact.

Still a further feature of the invention resides in the electrical switching contact itself.

DETAILED DESCRIPTION OF THE INVENTION

In accordance with the more detailed aspects of the present invention, the silver-iron materials of the present invention comprise 0.5 to 4.5% by weight iron and 0.05 to 2% by weight of one or more of an oxidic additive which is a member selected from the group consisting of magnesium oxide, calcium oxide, yttrium oxide, lanthanum oxide, titanium oxide, zirconium oxide, hafnium oxide, cerium oxide, niobium oxide, tantalum oxide, chromium oxide, manganese oxide, iron oxide, zinc oxide, aluminum oxide, indium oxide, silicon oxide and tin oxide, with the remainder being silver.

It is preferable to add 0.2 to 1.5% by weight of the oxidic component to the silver-iron material.

It has proved to be especially advantageous if the materials contain 0.2 to 1.2% by weight magnesium oxide, calcium oxide, yttrium oxide, lanthanum oxide, titanium oxide, zirconium oxide, hafnium oxide, cerium oxide, niobium oxide, tantalum oxide, aluminum oxide, and silicon oxide.

It is furthermore advantageous if the iron content is between 0.5 and 2.5% by weight.

The silver-iron materials previously used for the fabrication of electrical contacts normally contained between 10 and 20% by weight iron. It turned out, however, that a reduction of the iron content is accompanied by an improvement: of the excess-temperature behavior. At the same time, however, the welding behavior and the useful life deteriorate with decreasing iron content. It has now been surprisingly found that the useful life and the welding reliability increase in a superproportional manner by the addition of one or more of said oxides in amounts between 0.05 to 2% by weight without the excess-temperature value becoming worse. It is advantageous for the excess-temperature behavior if the iron content is below 4.5%. The materials of this invention can be resistance-welded. Also, they can be used to form compounds with copper-carrier materials having high bonding strengths. Materials whose iron content is below 2.5% by weight in which the amount of oxidic additives is below 1.2% by weight have especially proven themselves to be advantageous.

The materials of the invention as described herein can be economically produced and are comparable in all switching properties to the silver-nickel material; in particular, the excess temperature has values that even achieve those of the silver-nickel materials.

EXAMPLES

This achievement was demonstrated by electrical switching tests in series contactors. The tests were carried out in a 5.5 KW contactor under the switching conditions of AC1 according to DIN VDE 0660 (German Industrial Standard). The measurement of excess temperature took place on the contact bridges at a current loading of 20 A and was performed after each 200,000 switchings. The materials and the results of the switching tests carried out with these materials after a total switching load of 600,000 switching cycles are contained in the following table and show the improvement of the materials in accordance with the invention with regard to the contact heating in comparison to the known materials Ag and Ni (20%), and Ag, Fe (8.5%) and Zn (1.5%).

| Material | Average excess temperature in K. |
|---|---|
| Ag and Ni (20%) | 90 |
| Ag, Fe (8.5%) and Zn (1.5%) | 116 |
| Ag, Fe (4%) and MgO (1%) | 95 |
| Ag, Fe (2%) and MgO (0.5%) | 87 |
| Ag, Fe (4%) and $Y_2O_3$ (1%) | 100 |
| Ag, Fe (2%) and $Y_2O_3$ (0.5%) | 88 |
| Ag, Fe (4%) and CeO (1%) | 102 |
| Ag, Fe (2%) and CeO (0.5%) | 91 |
| Ag, Fe (4%) and $Ta_2O_5$ (1%) | 109 |
| Ag, Fe (2%) and $Ta_2O_5$ (0.5%) | 99 |
| Ag, Fe (4%) and ZnO (1%) | 107 |
| Ag, Fe (2%) and ZnO (0.5%) | 98 |
| Ag, Fe (4%) and $Al_2O_3$ (1%) | 102 |
| Ag, Fe (2%) and $Al_2O_3$ (0.5%) | 91 |
| Ag, Fe (4%) and $SnO_2$ (1%) | 107 |
| Ag, Fe (2%) and $SnO_2$ (0.5%) | 97 |
| Ag, Fe (2%) and $SiO_2$ (0.5%) | 94 |

The materials are produced by powder metallurgy by mixing the appropriate powders, cold isostatic pressing, sintering and extruding to wires or profiles.

The process for preparing an electrical switching contact comprises mixing silver; iron which is present in an amount of 0.5–4.5% by weight; and one or more of an oxidic additive selected from the group consisting of magnesium oxide, calcium oxide, yttrium oxide, lanthanum oxide, titanium oxide, zirconium oxide, hafnium oxide, cerium oxide, niobium oxide, tantalum oxide, chromium oxide, manganese oxide, iron oxide, zinc oxide, aluminum oxide, indium oxide, silicon oxide, and tin oxide, in an amount of 0.05–2% by weight; subjecting said mixture to cold isostatic pressing; sintering said mixture; and extruding said mixture to form an electrical switching contact.

The process may further comprise extruding the mixture (after sintering) into a wire and welding the wire onto a contact carrier substance.

Further variations and modifications of the foregoing will be apparent to those skilled in the art and are intended to be encompassed by the claims appended hereto.

German priority application 195 43 222.3 is relied on and incorporated herein by reference.

We claim:

1. Material for electrical switching contacts which is weldable onto a contact carrier substance comprising a mixture of silver;

iron which is present in an amount of 0.5–4.5% by weight; and at least one oxidic additive which is a member selected from the group consisting of magnesium oxide, calcium oxide, yttrium oxide, lanthanum oxide, titanium oxide, zirconium oxide, hafnium oxide, cerium oxide, niobium oxide, tantalum oxide, chromium oxide, manganese oxide, iron oxide, zinc oxide, aluminum oxide, indium oxide, silicon oxide, and tin oxide, which is present in an amount of 0.05%–2% by weight.

2. The material according to claim 1 wherein said oxidic additive is present in an amount of 0.2–1.5% by weight.

3. The material according to claim 1 wherein said oxidic additive is selected from the group consisting of magnesium oxide, calcium oxide, yttrium oxide, lanthanum oxide, titanium oxide, zirconium oxide, cerium oxide, niobium oxide, tantalum oxide, aluminum oxide, and silicon oxide, and is present in an amount of 0.2–1.2% by weight.

4. The material according to claim 1 wherein said amount of said iron is 0.5–2.5% by weight.

5. An electrical switching contact comprising a mixture of silver;

iron which is present in an amount of 0.5–4.5% by weight; and at least one oxidic additive which is a member selected from the group consisting of magnesium oxide, calcium oxide, yttrium oxide, zirconium oxide, hafnium oxide, cerium oxide, niobium oxide, lanthanum oxide, titanium oxide, tantalum oxide, chromium oxide, manganese oxide, iron oxide, zinc oxide, aluminum oxide, indium oxide, silicon oxide, and tin oxide, which is present in an amount of 0.05–2% by weight.

6. The electrical switching contact according to claim 5 wherein said oxidic additive is present in an amount of 0.2–1.5% by weight.

7. The electrical switching contact according to claim 5 wherein said oxidic additive is selected from the group consisting of magnesium oxide, calcium oxide, yttrium oxide, lanthanum oxide, titanium oxide, zirconium oxide, cerium oxide, niobium oxide, tantalum oxide, aluminum oxide, and silicon oxide, and is present in an amount of 0.2–1.2% by weight.

8. The electrical switching contact according to claim 5 wherein said amount of said iron is 0.5–2.5% by weight.

9. The process for preparing an electrical switching contact comprising mixing said material according to claim 1 to form a mixture;

subjecting said mixture to cold isostatic pressing;

sintering said mixture; and extruding said mixture to form an electrical switching contact.

10. The process according to claim 9 further comprising extruding said mixture into a wire; and welding said wire onto a contact carrier substance.

11. An electrical switching contact prepared by the process according to claim 9.

12. Material for electrical switching contacts consisting essentially of a mixture of silver;

iron which is present in an amount of 0.5–4.5% by weight; and at least one of an oxidic additive which is a member selected from the group consisting of magnesium oxide, calcium oxide, yttrium oxide, lanthanum oxide, titanium oxide, zirconium oxide, hafnium oxide, cerium oxide, niobium oxide, tantalum oxide, chromium oxide, manganese oxide, iron oxide, zinc oxide, aluminum oxide, indium oxide, silicon oxide, and tin oxide, which is present in an amount of 0.05%–2% by weight.

13. The material according to claim 12 wherein said oxidic additive is present in an amount of 0.2%–1.5% by weight.

14. The material according to claim 12 wherein said oxidic additive is a member selected from the group consisting of magnesium oxide, calcium oxide, yttrium oxide, lanthanum oxide, titanium oxide, zirconium oxide, cerium oxide, niobium oxide, tantalum oxide, aluminum oxide, and silicon oxide, and is present in an amount of 0.2–1.2% by weight.

15. The material according to claim 12 wherein said amount of said iron is 0.5–2.5% by weight.

16. An electrical switching contact comprising the material defined in claim 12.

17. The electrical switching contact according to claim 16 wherein said oxidic additive is present in an amount of 0.2–1.5% by weight.

18. The electrical switching contact according to claim 16 wherein said oxidic additive is a member selected from the group consisting of magnesium oxide, calcium oxide, yttrium oxide, lanthanum oxide, titanium oxide, zirconium oxide, cerium oxide, niobium oxide, tantalum oxide, aluminum oxide, and silicon oxide, and is present in an amount of 0.2%–1.2% by weight.

19. The electrical switching contact according to claim 16 wherein said amount of said iron is 0.5–2.5% by weight.

20. The process for preparing an electrical switching contact comprising mixing said material according to claim 12 to form a mixture;

subjecting said mixture to cold isostatic pressing;

sintering said mixture; and extruding said mixture to form an electrical switching contact.

* * * * *